United States Patent [19]

Blanc

[11] 4,273,272

[45] Jun. 16, 1981

[54] LIQUID DISPENSER

[75] Inventor: Max A. Blanc, 5 Rue du Pilori, 64 100 Bayonne, France

[73] Assignees: William B. Anderson, West Palm Beach, Fla.; Max Alain Blanc, St. Jean de Luz, France; part interest to each

[21] Appl. No.: 93,381

[22] Filed: Nov. 13, 1979

[51] Int. Cl.[3] ..... B67D 5/60

[52] U.S. Cl. ..... 222/464; 285/177

[58] Field of Search ..... 222/464, 211, 282; 285/177, 260

[56] References Cited

U.S. PATENT DOCUMENTS

| | | | |
|---|---|---|---|
| 2,483,661 | 10/1949 | Neas | 222/464 |
| 3,221,945 | 12/1965 | Davis | 222/211 |
| 3,547,296 | 12/1970 | Greenberg | 222/464 |

FOREIGN PATENT DOCUMENTS

| | | | |
|---|---|---|---|
| 692722 | 8/1964 | Canada | 285/177 |

*Primary Examiner*—H. Grant Skaggs
*Attorney, Agent, or Firm*—Brumbaugh, Graves, Donohue & Raymond

[57] ABSTRACT

A liquid dispenser which includes a flexible tube having a relatively heavy intake fitting engageable with the lower end of the flexible tube, the relatively heavy intake fitting having a longitudinally extending passage through it containing a stop engageable with the lower end of the tube and a constriction engaging the outer periphery of the tube at a distance spaced above the stop, the intake fitting and the liquid contents both being displaced by gravity to the same region within the container when the container is tilted.

5 Claims, 8 Drawing Figures

LIQUID DISPENSER

This invention relates to a liquid dispensing device, such as a household or garden spray, in which liquid is dispensed from a container to an upper discharge through a tube which depends into the container and draws the liquid upwardly therethrough by pumping action or aspiration.

The liquid dispenser of the present invention embodies a flexible tube having a relatively heavy intake fitting at the lower end so as to be influenced by gravity when the container is tilted from its upright position. Since both the liquid and the intake fitting move to the same region by gravity when the container is tilted, the container can be tilted in all directions from the upright through substantial angles while still maintaining the lower intake end of the tube in communication with the liquid so that substantially the entire contents can be discharged.

The length of the tube maintains the lower end of the intake fitting in proximity to the bottom of the container when the container is in upright condition. Preferably, the lower end of the fitting has an upwardly sloped outer surface surrounding the intake opening so that when the container is tilted and the fitting engages a side wall of the container the lower intake end of the fitting will be in proximity to the wall.

The intake fitting is readily secured to the lower end of the flexible tube by inserting the lower end of the tube through a constricted portion of a stepped passage and into engagement with a stop. In a preferred embodiment of the invention, the passage has a plurality of steps and a plurality of constrictions so as to be mountable on flexible tubes of different size.

For a complete understanding of the present invention, reference should be made to the detailed description which follows and to the accompanying drawings, in which.

Figure 1:
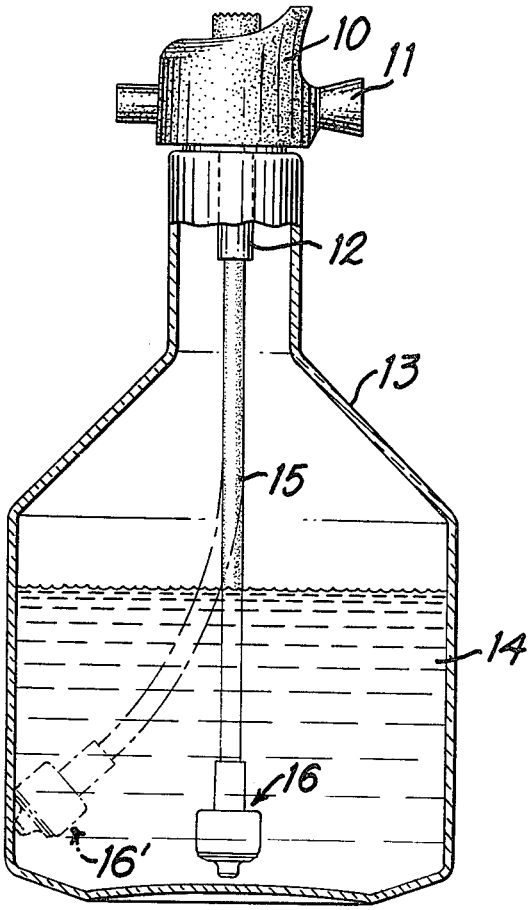
FIG. 1 is an elevational view of a liquid dispenser embodying the present invention with the container thereof shown in cross-section.

The liquid dispenser of the present invention is shown in FIG. 1 in the form of a portable sprayer comprising a cap 10 having a spray discharge 11 and a depending intake 12 and a container 13 for the liquid 14 to be dispensed. The cap can be screwed onto the neck of the container.

The liquid dispenser is shown schematically in as much as it can be any conventional liquid dispensing device which lifts the liquid from the container by pressure, such as by a pumping action or by aspiration.

The liquid is lifted from the container to the intake of the cap through a flexible tube 15 having an intake fitting 16 secured at the lower end. The flexible tube 15 may be force-fitted or otherwise connected to the intake

Figure 4A:
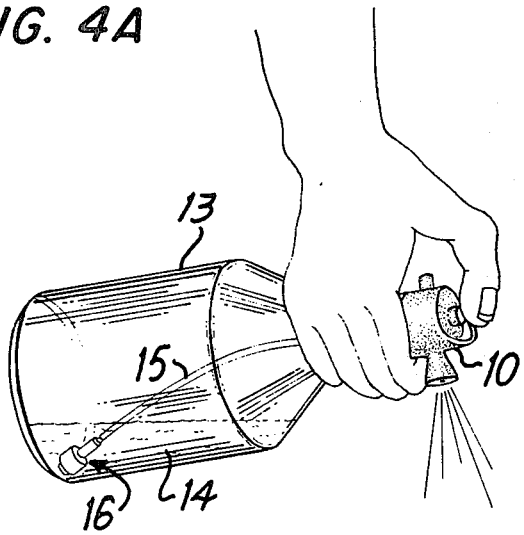
FIGS. 4A and 4B show the liquid dispenser oriented in different directions from the upright position.
Figure 4B:
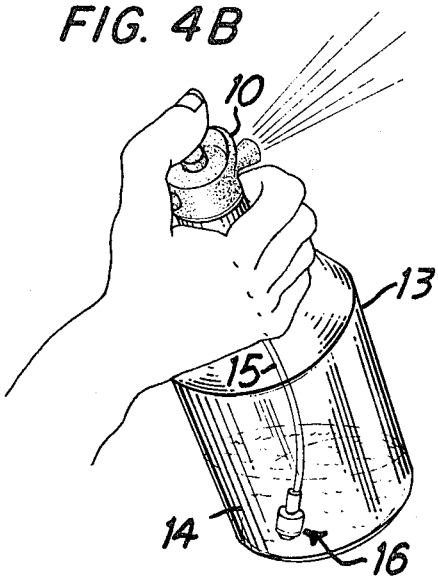

12 of the cap, and the intake fitting 16 is force-fitted to the lower end of the flexible tube. The length of the flexible tube and fitting should maintain the lower end of the fitting in proximity to the lower end of the container, and the weight of the fitting relative to the liquid which it displaces should be sufficiently heavy so that when the container is oriented from the upright condition and tilted in various directions, as shown in FIGS. 4A and 4B, the fitting will be displaced by gravity, thereby bending the flexible tube. Thus, when a relatively small amount of liquid remains in the container both the liquid and the intake fitting will be displaced by gravity to the same region within the container and the intake fitting will assume a position within the lower region of the liquid.

Figure 2:
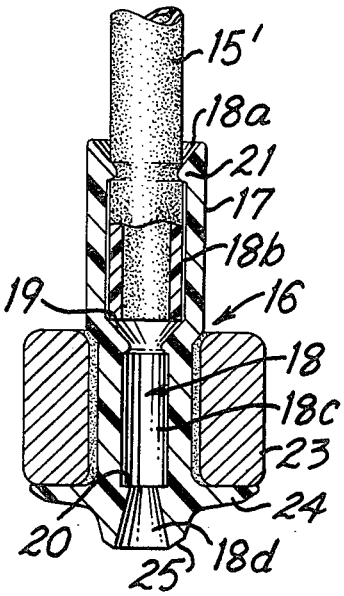
FIG. 2 is a cross-sectional view of the intake fitting shown mounted to a larger tube.
Figure 3:
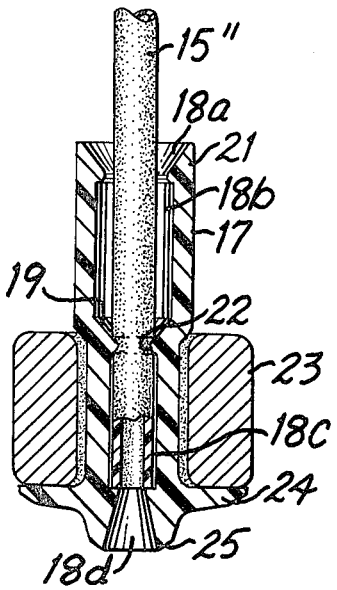
FIG. 3 is a view similar to FIG. 2 showing the intake fitting mounted to a smaller tube.

The intake fitting 16, as shown in FIGS. 2 and 3, is a tubular member 17 having a stepped passage 18 extending longitudinally therethrough. The stepped passage 18 includes an opening **18*a* in the upper end of the fitting, an upper passage portion 18*b* communicating with the opening 18*a*, a lower portion 18*c* communicating with the portion 18*b* and a lower, tapered intake portion 18*d* communicating with the portion 18*c*. Steps or shoulders 19 and 20 connect the portions 18*b*, 18*c* and 18*c*, 18*d*, respectively. The upper step or shoulder 19 forms a stop for the lower end of a tube 15' of larger circumference or perimeter and the lower step or shoulder 20 forms a stop for the lower end of a tube 15'' of smaller circumference or perimeter, as shown in FIGS. 2 and 3. A constriction 21 is formed within the passage 18 at a distance spaced above the stop 19 to engage the outer perimeter of the large tube tightly. A smaller constriction 22 is spaced above the stop 20 and below the stop 19 so as to engage the outer perimeter of the smaller tube 15'** tightly. Thus, the same intake fitting can be used in conjunction with flexible tubes of different size.

The tube 15 is preferably made of a highly flexible plastic material and the intake fitting 16 is made of a relatively rigid plastic material. It is desirable that the intake fitting be weighted so as to be readily displaced by gravity and at the same time bend the flexible tube when the container is tilted. Toward this end, an annular weight 23 is carried on the fitting by an outwardly extending support flange 24 formed near the lower end of the fitting. The annular weight is force-fitted onto the upper end of the fitting and into engagement with the support flange 24. It can be snap-locked in position or permanently anchored in place or maintained in position by the tight-fitting engagement with the outer periphery of the upper portion of the fitting to retain the weight on the support. If the weight is metal, it is preferably coated with plastic or other protective coating to avoid chemical reaction with the liquid.

The depending lower end of the intake fitting beneath the support flange 24 has an upwardly and outwardly sloped outer surface 25 surrounding the intake end **18*d* so that when the container is tilted and the tube 15 is bent, as shown in phantom lines in FIG. 1, it will engage an inner wall of the container and maintain the intake end 18*d* in proximity thereto so that substantially all of the liquid in the container can be dispensed. The outer periphery of the support flange 24 preferably lies on the extension of the tapered surface 25 to position the intake end 18*d* in proximity to the side wall of the container, as shown in phantom lines in FIG. 1**.

Figure 5:
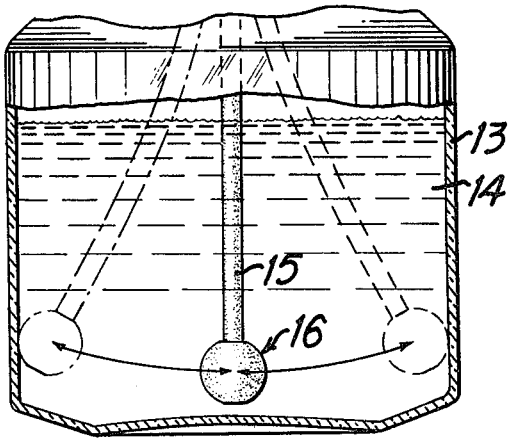
FIG. 5 is a cross-sectional elevation of the container showing an alternative embodiment of the intake fitting.
Figure 6:
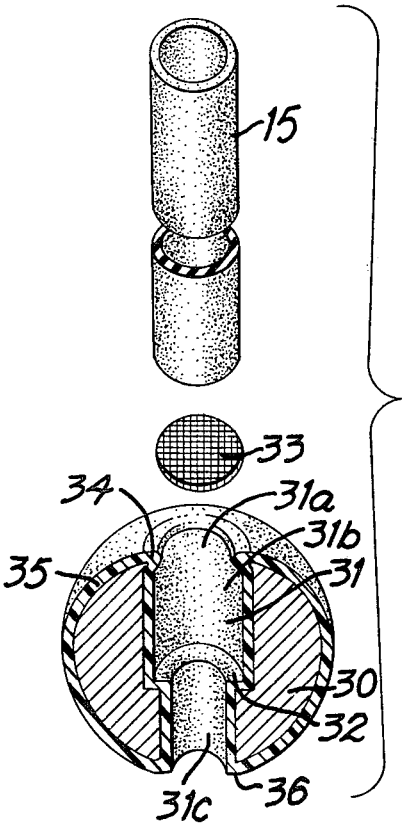
FIG. 6 is an exploded perspective view of the tube and intake fitting shown in FIG. 5.
Figure 7:
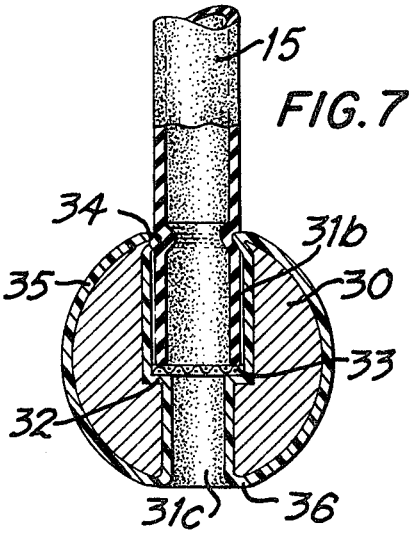
FIG. 7 is a cross-sectional view of the tube and intake fitting shown in FIG. 5.

An alternative intake fitting 16, as shown in FIGS. 5 through 7, is a generally spheroidal weight 30 having a stepped passage 31 extending longitudinally therethrough. The stepped passage includes an opening 31*a* in the upper end of the fitting, an upper passage portion 31*b* communicating with the opening and a lower passage portion 31*c* communicating with the portion 31*b*. The lower end of the portion 31*c* serves as the intake for the discharge of the liquid from the container.

A step or shoulder 32 intermediate the passage portions 31*b* and 31*c* forms a stop for the lower end of the tube 15, as shown in FIG. 7. A screen or filter 33 may be seated on the shoulder 32 beneath the lower end of the flexible tube to prevent any dirt or residue from being discharged from the container. A constriction 34 formed within the passage and spaced a distance above the shoulder 32 engages the outer perimeter of the tube tightly to hold the intake fitting on the flexible tube.

The intake fitting is preferably coated with a resilient protective plastic material 35 to prevent any chemical reaction of the liquid on the intake fitting and, in addition, to act as a resilient buffer to protect the container from impact by the intake fitting.

The curvature of the bottom of the intake fitting surrounding the lower intake provides an upwardly sloped outer surface 36 so that when the container is oriented from an upright position and the intake fitting is caused to engage an inner wall of the container the lower intake end of the fitting will be in proximity to the wall.

The multiposition liquid dispenser of the present invention can be tilted in all directions from the upright position through an angle of nearly 90° from the upright position when the contents are almost fully diminished and through an angle of substantially greater than 90° from the upright position when the container is full or partially full.

The application has been described in preferred forms and by way of example and many variations and modifications may be made within the scope of the invention. The invention, therefore, is not to be limited to any specified form or embodiment, except in so far as such limitations are expressly set forth in the claims.

I claim:

1. In a liquid dispenser in which a liquid is dispensed from a container through an upper discharge by means of a depending tube, the improvement of an intake fitting engageable with the lower end of the tube and comprising a passage through the intake fitting, a stop within said passage engageable by the lower end of the tube when it is inserted in the passage and constriction means within the passage and spaced above the stop for engaging the outer periphery of the tube to lock the fitting on the lower end of the tube, said intake fitting being relatively heavy in relation to the liquid which it displaces so that both it and the liquid can be displaced by gravity to the same region within the container and with the lower end of the fitting positioned in the lower region of the liquid, said intake fitting including a tubular formation of relatively lightweight material having a passage extending therethrough, an annular weight slidably engageable onto the upper end of the tubular formation, a support outwardly extending from the tubular formation for the support of the annular weight, a depending portion of the tubular formation beneath said support, a lower end of the passage passing through the depending formation and an upwardly and outwardly shaped outer surface formed on said depending formation surrounding the lower end of the passage.

2. In a liquid dispenser as set forth in claim 1 in which the tube is made of a flexible material which readily bends under the influence of the relatively heavy intake fitting.

3. An intake fitting as set forth in claim 1 in which the passage is a stepped passage larger at the upper end and smaller at the lower end and in which the step forms the stop for the lower end of the tube.

4. A fitting as set forth in claim 3 in which the passage has at least two steps, the lower step forming a stop for a tube of smaller perimeter and the upper step forming a stop for a tube of larger perimeter, constriction means between the two stops for engaging the tube of smaller perimeter and constriction means between the upper stop and the upper end of the fitting for engaging the tube of larger perimeter.

5. An intake fitting as set forth in claim 1 in which said sloped surface is a tapered surface and the outer periphery of the weight support lies on a line which forms an extension of said tapered surface.

* * * * *

UNITED STATES PATENT AND TRADEMARK OFFICE

CERTIFICATE OF CORRECTION

PATENT NO. : 4,273,272

DATED : June 16, 1981

INVENTOR(S) : Max A. Blanc

It is certified that error appears in the above—identified patent and that said Letters Patent is hereby corrected as shown below:

Column 4, line 22 - "shaped" should read --sloped--

Signed and Sealed this

*First* Day of *September 1981*

[SEAL]

*Attest:*

GERALD J. MOSSINGHOFF

*Attesting Officer*

*Commissioner of Patents and Trademarks*